US006579090B1

(12) United States Patent
Taubitz et al.

(10) Patent No.: US 6,579,090 B1
(45) Date of Patent: Jun. 17, 2003

(54) LIQUID FUEL BURNER

(76) Inventors: Robert Taubitz, 576 Main St., Antioch, IL (US) 60002; Robert D. Taubitz, 576 Main St., Antioch, IL (US) 60002; Ronald Taubitz, 576 Main St., Antioch, IL (US) 60093

( * ) Notice: Subject to any disclaimer, the term of this patent is extended or adjusted under 35 U.S.C. 154(b) by 0 days.

(21) Appl. No.: 10/086,058

(22) Filed: Feb. 27, 2002

(51) Int. Cl.[7] ..... F23D 3/24
(52) U.S. Cl. ..... 431/320; 431/126; 431/343
(58) Field of Search ..... 431/320–325, 431/315, 344, 146, 343, 34, 144, 345, 317, 126; 126/96, 260, 265

(56) References Cited

U.S. PATENT DOCUMENTS

| | | | | |
|---|---|---|---|---|
| 13,860 | A | | 11/1855 | Bennett |
| 28,536 | A | | 5/1860 | Lowe |
| 213,141 | A | | 3/1879 | Stineman et al. |
| 2,692,492 | A | | 10/1954 | Hepburn |
| 3,360,966 | A | * | 1/1968 | Binderman ..... 431/320 |
| 3,838,795 | A | | 10/1974 | Berg |
| 4,728,286 | A | | 3/1988 | Olsen |
| 4,781,577 | A | * | 11/1988 | Stewart ..... 431/320 |
| D305,801 | S | | 1/1990 | Herb |
| 4,892,711 | A | | 1/1990 | Tendick, Sr. |
| 5,000,678 | A | | 3/1991 | Thompson |
| 5,127,825 | A | | 7/1992 | Tendick, Sr. |
| 5,395,234 | A | * | 3/1995 | Gutierrez ..... 431/324 |
| 5,759,025 | A | | 6/1998 | Hart |
| 5,938,430 | A | | 8/1999 | Majerowski |
| 6,010,333 | A | | 1/2000 | Tendick, Sr. |
| 6,159,002 | A | | 12/2000 | LeJeune |
| 6,217,314 | B1 | | 4/2001 | Kiesinger et al. |

* cited by examiner

*Primary Examiner*—James C. Yeung
(74) *Attorney, Agent, or Firm*—John C. Shepard

(57) ABSTRACT

A liquid fuel burner adapted to be inserted into an opening of a supporting base, such as a statue or other art work, includes a container to hold combustible fuel, a tube having one end attached to an opening in the container, a collar assembly secured to the other end of the tube and having a cap closing the end of the tube and a flange part to support the burner in the opening, and a wick extending from the container through the tube and being held within an opening defined in the cap. The cap may include a glass wick holder to support the wick in burning position thereabove. The fuel container may be defined by one or more flexible bladders which are attached to the tube by insulation, tape, heat-shrink tubing, or a wire clamp.

46 Claims, 8 Drawing Sheets

185
153
190
181
180
150
152
162
187
158
183
182
151
140
141
142
177
144
186
173
156
172
184
170
147
175
160
167
161
154
168
145
148
169

251
245
210
244
246
225
212
249
222
248
211
200
201
242
202
240
215
239
216
237
218
207
236
219
229
221
227
228
224
204
214
205
230
231
233
234
208
253
252

186
185
153
184
181
180
152
182
188
187

194
193
192

197
198
196

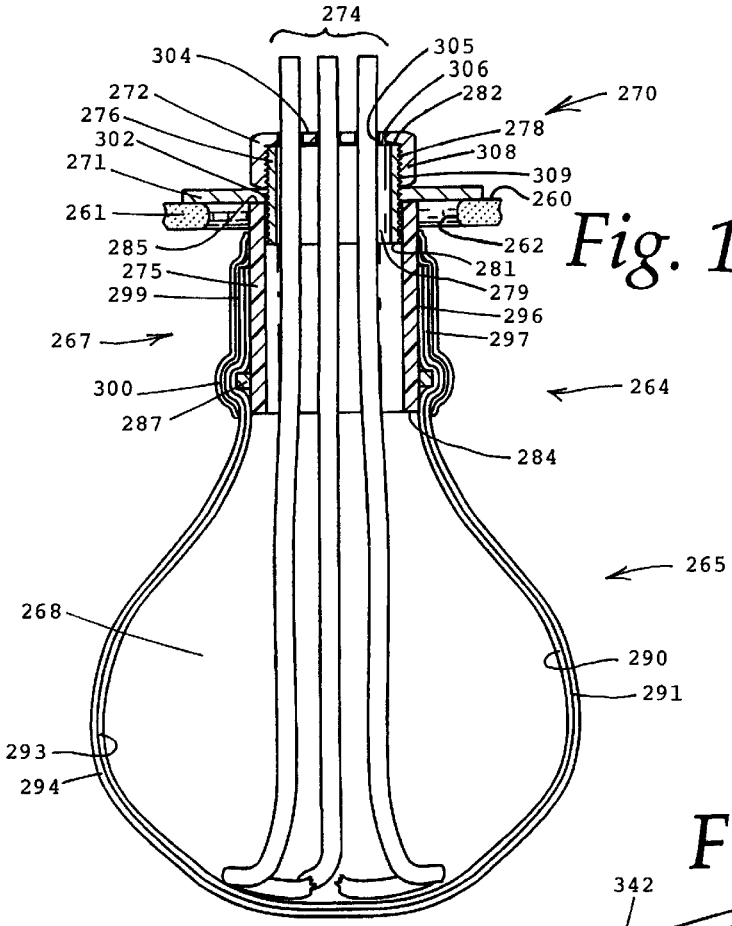
Fig. 15
Fig. 9
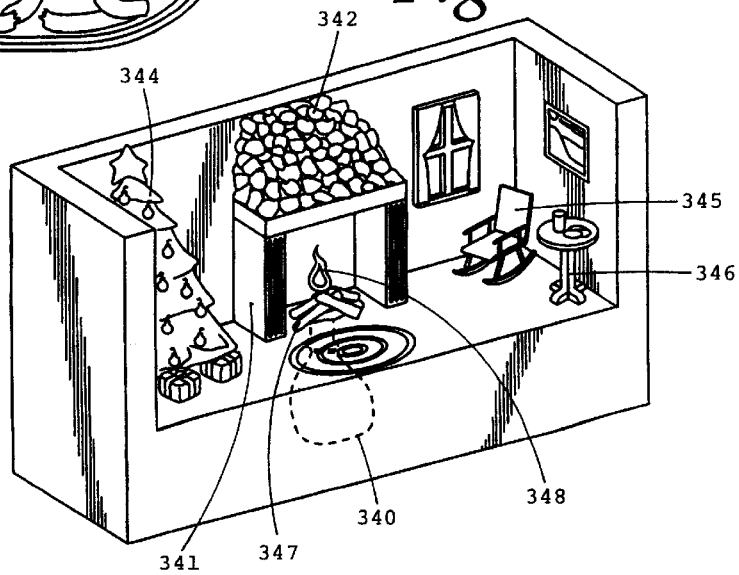

LIQUID FUEL BURNER

BACKGROUND OF THE INVENTION

1. Technical Field

This invention relates generally to a liquid fuel burner and, more particularly, to a removable liquid fuel burner fittable into a base structure and having a refillable fuel-holding container.

2. Background Art

In the prior art, oil burners and oil lamps are well-known. The following United States patents are representative of the prior art and illustrate many of the devices that have been used in the past.

In Bennett, U.S. Pat. No. 13,860 entitled "Lamp" issued Nov. 27, 1855, a fluid lamp is shown wherein an india rubber or elastic bag is placed inside an ordinary lamp and is lined with gutta percha or other substance which protects the bag from chemically reacting fluid fuel. The liner is attached to the inside periphery of a top which has a pair of wick tubes.

In Lowe, U.S. Pat. No. 28,436 entitled "Vapor Lamp" issued May 29, 1860, a vapor lamp has a two-part base enclosing a wire-woven bag filled with gas-absorbing cotton material in contact with strands of wick and includes an upright tube into which the wick extends and having orifices at its end. The lamp is refillable by removing a cork from an opening in a tube defined at its bottom.

Thompson, U.S. Pat. No. 5,000,678 entitled "Leak Proof Burner Assembly for Oil Lamps Using Plastic Fuel Containers" issued Mar. 19, 1991, includes a cap member carrying a wick which has a frusto-conical or hollow crown and a central cylindrical and which is crimped onto a fuel canister.

Tendick, Sr., U.S. Pat. No. 6,010,333 entitled "Refillable Burner Assembly" issued Jan. 4, 2000, shows a burner assembly including a fuel container having a externally-threaded neck with a central opening and a one-piece internally-threaded cap screwed onto the neck and having an axially-extending wick holder crimpable on the crown of the cap to hold a wick.

Tendick, Sr., U.S. Pat. No. 5,127,825 entitled "Burner Assembly for Oil Lamps Using Plastic Fuel Containers" issued Jul. 7, 1992, shows a burner assembly with a tubular metal wick holder which has a releasable bayonet connection to a fuel canister.

Tendick, Sr., U.S. Pat. No. 4,892,711 entitled "Fragrance Dispensing Device" issued Jan. 9, 1990, includes a cap member carrying a wick which has a frusto-conical or hollow crown and a central cylindrical and which is crimped onto a fuel canister.

Olsen, U.S. Pat. No. 4,728,286 entitled "Lamp for Liquid Fuel" issued Mar. 1, 1988, shows a lamp having a conical wick holder which supports a wick hanging down into a fuel container.

Kiesinger et al., U.S. Pat. No. 6,217,314 entitled "Disposable, Recyclable Oil Candle" issued Apr. 17, 2001, shows a disposable oil candle with a fuel cell having a ring that may be snapped into a cooperating groove of an exterior shell shaped like a candle.

LeJeune, U.S. Pat. No. 6,159,002 entitled "Oil Candle Having an Oil Seal" issued Dec. 12, 2000, shows an oil candle including a candle base containing oil and a tapered oil seal surrounding a glass tube holding the wick, the seal fitting snugly into the mouth of the base to act as a stopper therefor.

Herb, U.S. Design Pat. No. 305,801 entitled "Oil Candle for Insertion into a Wine Bottle or Similar Article" issued Jan. 30, 1990, is an ornamental design for an oil candle insertable into a wine bottle and includes a narrow bottle with a wick holder at the top.

While the prior art burners function well for their intended purpose, they cannot easily be adapted for use with pre-existing bases, statuary and the like, which might be made of marble, bronze, or ceramic.

BRIEF SUMMARY OF THE INVENTION

The present invention is directed to overcoming one or more of the problems as set forth above.

It is a general object of the present invention to provide a new and improved liquid fuel burner which is simple, compact, inexpensive and functional.

It is another object of the invention to provide a liquid fuel burner which can be used with a variety of holders, including statuary, and which can be easily refilled and reused. The fuel burners intended herein can be easily and conveniently fitted into existing hollow statues, bases or holders, without substantial modification thereto. Thus, each individual object need not be specially designed or configured to receive the burner.

It is a further feature of the invention to provide a liquid fuel burner which minimizes the hazard of fire caused by accidental spills and leaks.

According to the present invention, a liquid fuel burner is adapted to be inserted into an opening of a supporting base, such as a statue or other art work, includes a container to hold combustible fuel, a tube having one end attached to an opening in the container, a collar assembly secured to the other end of the tube and having a cap closing the end of the tube and a flange part to support the burner in the opening, and a wick extending from the container through the tube and being held within an opening defined in the cap.

In an exemplary embodiment of the invention, the fuel container is a flexible bladder secured to the tube. A second flexible bladder may surround the first bladder to decrease the chances of fuel leakage caused by rips or punctures to the bladders. The bladders are attached to the underlying tube by tape, heat shrink tubing, clamps, or other means. The tube has a flange ring, or other structure, underlying the bladders to further hold the bladders onto the outside of the tube.

In another exemplary embodiment, a band of insulation may be provided between the tube and the bladders or between the bladders and the heat shrink tubing to prevent damage to the bladders which may be caused by heat.

In another exemplary embodiment of the invention, the bladder has multiple neck portions adapted to receive individual tubes and wicks thereby permitting a plurality of burners to draw fuel from a single reservoir.

In yet another exemplary embodiment of the invention, the fuel container is a bottle, which may be made of plastic, which is screwed onto the tube or press fit thereon and clamped.

In a further exemplary embodiment of the invention, the cap include a glass wick holder to support the wick in burning position thereabove. A split ring seal is positioned between the cap and the tube to hold the wick holder and provide a vent hole.

A feature of the invention is that the burner may be used in a variety of bases, which bases may be of any form or size, so long as they have an opening adapted to suspend the burner therein and have space therewithin to receive the fuel reservoir. The burner's bladder reservoir is flexible to conform, when filled with fuel, to the space into which it is placed.

BRIEF DESCRIPTION OF THE DRAWINGS

The details of construction and operation of the invention are more fully described with reference to the accompanying drawings which form a part hereof and in which like reference numerals refer to like parts throughout.

In the drawings:

FIG. 9 is a perspective view of a base resembling a room with a fireplace employing a burner constructed in accordance with the present invention;

DESCRIPTION OF THE PREFERRED EMBODIMENTS

Best Modes for Carrying Out the Invention

Figure 5:
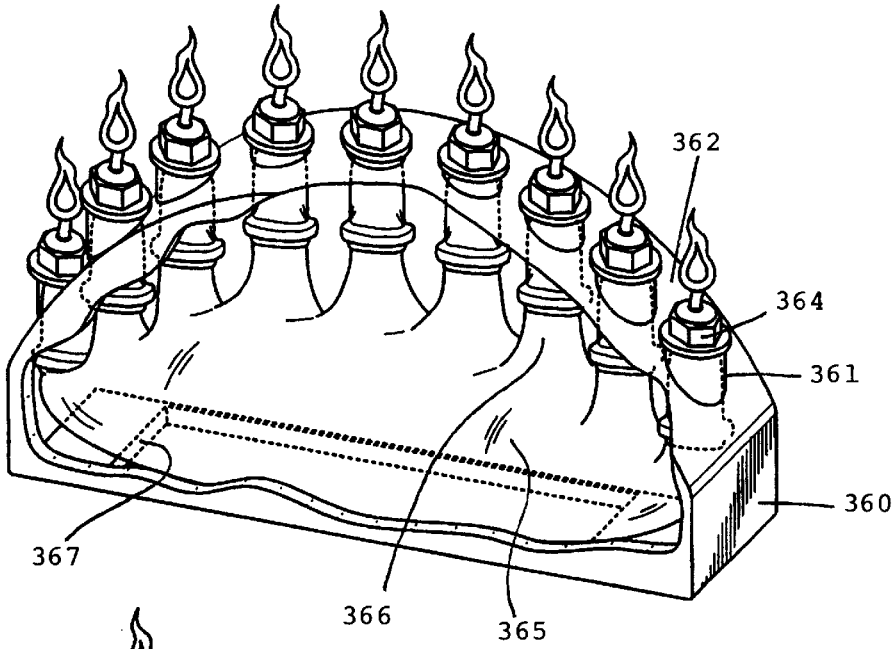
FIG. 5 is a perspective view partially in section of a base holding multiple burners attached to a single fuel bladder constructed in accordance with the present invention.
Figure 6:
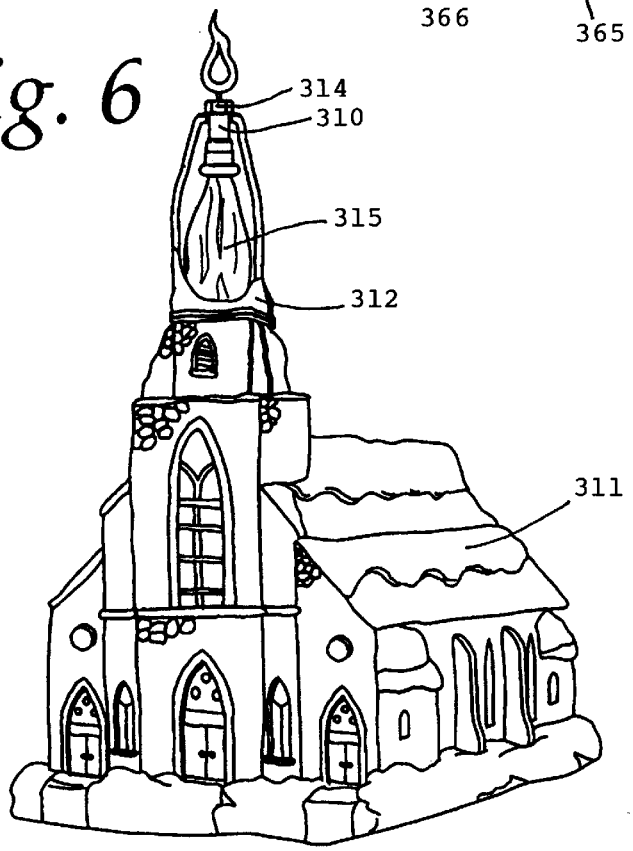
FIG. 6 is a perspective view partially in section of a base resembling a snow-covered church employing a burner constructed in accordance with the present invention.
Figure 7:
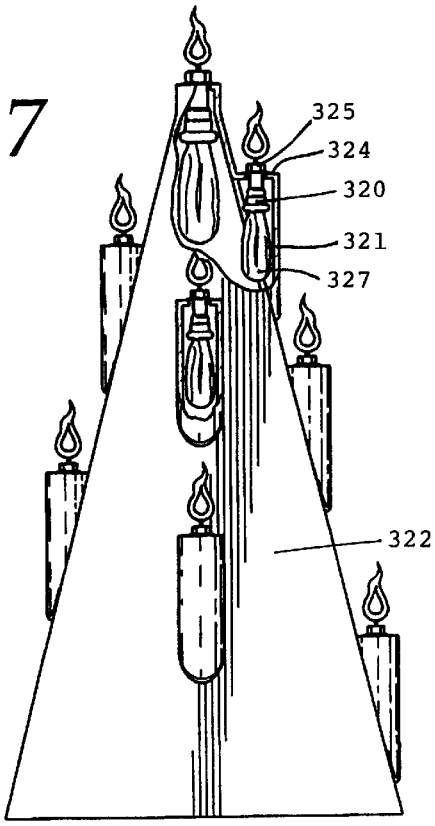
FIG. 7 is a perspective view partially in section of a base resembling a candle tree holding multiple burners constructed in accordance with the present invention.
Figure 8:
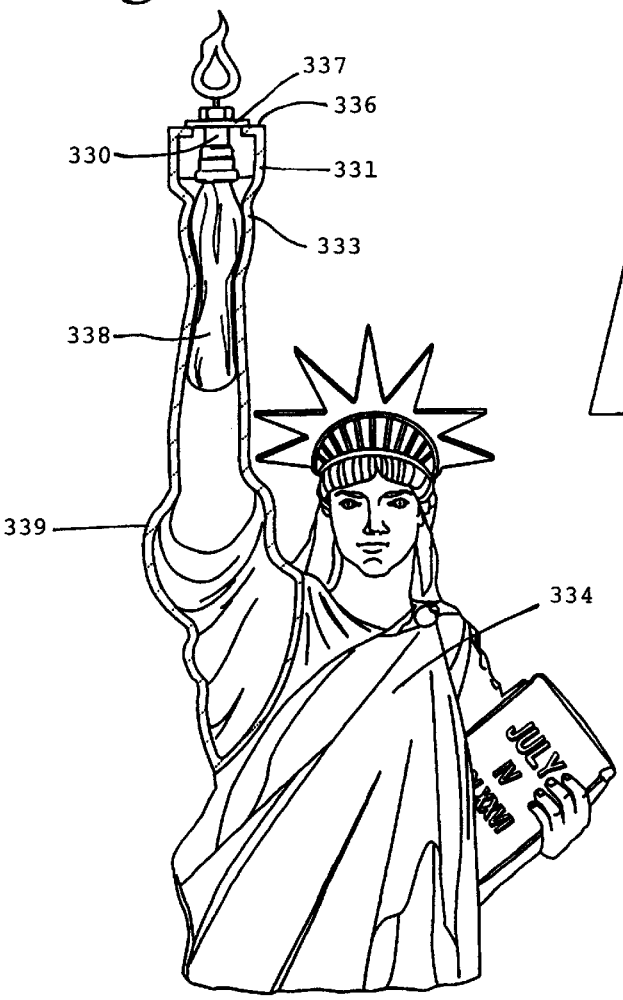
FIG. 8 is a perspective view partially in section of a base resembling the "Statue of Liberty" employing a burner assembly constructed in accordance with the present invention.
Figure 10:
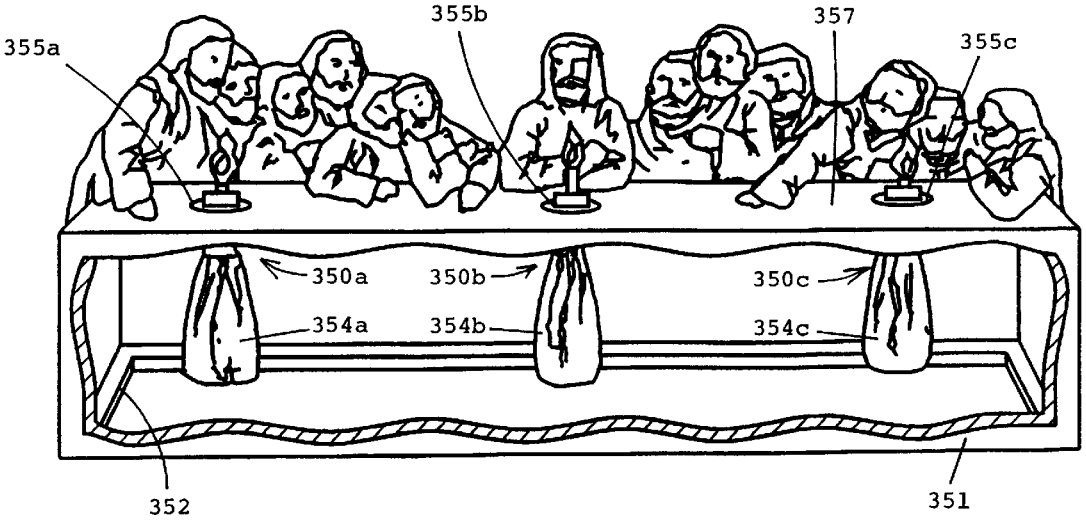
FIG. 10 is a perspective view partially in section of a base resembling a depiction of the "Last Supper" and holding multiple burners constructed in accordance with the present invention.

Referring to the drawings, FIGS. 5 through 10 show various applications for the different embodiments of the oil burners described herein. FIG. 6 shows the oil burner suspended at the top of a church steeple. FIG. 7 shows a large number of oil burners suspended in the various side extensions of a pyramid-shaped candle tree. FIG. 8 is an oil burner replacing the torch held aloft by the right hand of a statue resembling the "Statue of Liberty" found in New York harbor. FIG. 9 is an oil burner suspended in the fireplace at the base of a chimney in a small replica of a room, which has a model of a Christmas tree, a chair and a table. FIG. 10 shows three oil burners placed in a common base, which is a statue depicting the "Last Supper." FIG. 5 shows a different version of the invention wherein nine burners are attached to a common bladder that has been formed with nine extending necks. Obviously, an oil burner constructed in accordance with the invention of the applicants can be used with an almost uncountable number of artistic and non-artistic bases as the user desires, but for purposes of sample illustration, only a relatively few are described herein.

Figure 1:
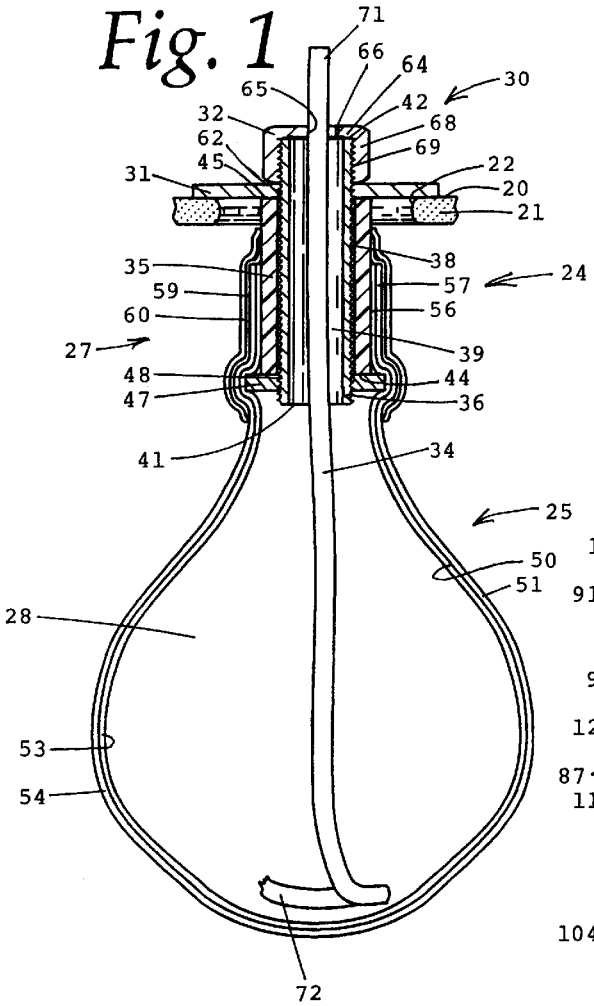
FIG. 1 is a cross-sectional view of a first embodiment of a burner constructed in accordance with the present invention.

Referring to FIG. 1, the generally horizontal top surface 20 of a statuary base 21 defines an opening 22 into which the oil burner and fuel container assembly, generally designated 24, is inserted and suspended. The oil burner 24 includes a container, generally designated 25, for holding combustible fluid, a tube, generally designated 27, communicating with the interior 28 of the container 25 and extending upwardly therefrom, a top collar, generally designated 30, including an upper collar flange ring 31 extending radially outward from the tube 27 and spaced downwardly from the upper end of the tube 27 and a cap 32 secured to the top of the tube 27, and a wick 34 extending from the interior 28 of the container 25, through the tube 27 and the cap 32 and outward above the cap 32.

The tube 27 is made up of an elongate, cylindrical plastic outer tube 35 and an elongate, cylindrical metal inner tube 36 positioned coaxially within the outer tube 35. The inner tube 36 has an external helical thread 38 and an internal passage 39 extending axially from its lower end 41 to its upper end 42. The longer inner tube 36 extends downward from the lower end 44 and upward from the upper end 45 of the shorter outer tube 35. A lower flange ring 47, which may a suitable nut or washer, has an internal helical thread 48 and is screwed onto the exposed lower of the inner tube 36 to a position adjacent its lower end 41 abutting the lower end 44 of the outer tube 35. As will be seen later herein, the lower flange ring 47 acts as an attachment means to grip the fuel container 25 and prevent it from slipping off the tube 35.

The inner tube 36 is made of metal and the outer tube 35 of plastic, but other materials, such as glass, rubber and ceramic, can be used. Clearly, the use of materials in contact with the fuel container 25 which are not heat conductive is desirable. Note that the inner tube 36 can be replaced by two shorter tubes which engage and are held by the inner wall of the outer tube—an upper tube extending upwardly from the outer tube and a lower tube axially spaced from the upper tube and extending downwardly from the outer tube.

The fuel container 25, or lamp oil reservoir, is defined by internal and external collapsible bladders, designated 50 and 51, respectively. The bladders 50 and 51 each have a globe portion, 53 and 54, respectively, and a neck portion, 56 and 57, respectively, extending from their respective globe portions 53 and 54. During assembly of the oil burner, the internal bladder 50 is positioned so that its neck portion 56 is situated around the outer tube 35 with the upper end of the neck portion 56 situated between the flange ring 47 and the upper end 45 of the outer tube 35. The external bladder 51 is positioned so that the internal bladder 50 is located therewithin with the neck portion 57 of the external bladder 51 surrounding the neck portion 56 of the internal bladder 50.

With the bladders 50 and 51 in place on the tube 35, the tube 35 and the overlying bladder neck portions 56 and 57 are spirally wrapped with a band of overlying insulating tape 59 from a point above the bladder neck portions 56 and 57 to a point below the flange ring 47. After the bladders 50 and 51 are tightly wrapped in place, a band of overlying heat shrink tubing 60 is placed over the insulating tape 59. The tubing 60 extends upwardly and downwardly from the upper and lower extents of the tape 59. The tubing 60 is shrunk in place with heat so that the assembly is secured around the lower flange ring 47 and neatly finished. The ring 47 keeps the bladders 50 and 51 from sliding downwardly off the end of the tube 35. The ring 47 may be an integrally formed flange on the outer tube or grooves, shoulders, knurls or similar structure carried by the outer tube. By using a separate, or non-integral, flange or by integrally forming flanges, grooves and the like directly on the tube exterior surface, the exterior surface of the outer tube adjacent its lower end is made diametrically non-uniform along the vertical section which the bladders overly, thereby limiting movement of the bladders along the tube.

The bladders 50 and 51 are made of flexible, oil resistant material, such as mylar, polyethylene, vinyl, polyester, polyvinyl chloride, or the like, which is impermeable to and chemically unreactive with combustible fuels or oils, such as lamp oil. Having internal and external bladders provides backup against leakage or spillage in case one of the bladders is torn or punctured. The bladders 50 and 51 form fluid reservoirs which can expand up to 4 inches or so in diameter and hold 2 to 12 ounces of combustible fluid, which should be sufficient fuel for a long burn. The bladders 50 and 51 should not be much larger since a wick of the type intended can only draw fluid by capillary action about 5 inches or so. The fuel intended to be used herein is lamp oil, but other wickable fuels, such as liquid paraffin or kerosene, can be used. It should also be understood that the bladders do not have to be globe-shaped or have outwardly extending neck portions to be suitably employed as an oil reservoir.

The upper collar flange ring 31 of the collar 30 is a flat, cylindrical metal piece, or washer, with a central annular opening having an internal helical thread 62 adapted to cooperatively engage the external thread 38 adjacent the upper end of the inner tube 36 to fix it thereto. The flange ring 31 is threaded downwardly onto the top of the inner tube 36 until it abuts the upper end 45 of the outer tube 35 so that the inner tube 36 is axially fixed within the outer tube 35. Since the size of the base opening 22 might be as small as ⅝ inch or so in diameter, the ring 31 could be ¾ inch in diameter to 6 or more inches depending on the base structure and the opening therein.

The cap 32 has a radially extending upper wall 64 defining a central opening 65 for the wick 34 and a vent hole 66, a skirt 68 connected to the periphery of the upper wall 64 and extending downward relative to the upper wall 64, and an internal helical thread 69 formed on the inward cylindrical wall of the skirt 68 adapted to cooperatively engage the exposed external thread 38 adjacent the upper end 42 of the inner tube 36. The cap 32 may take the form of a hex cap nut with a six-sided skirt. While the upper wall 64 closes the upper end of tube 36, the vent hole 66 permits ambient air to communicate with the interior 28 of the reservoir. While the cap and the collar flange ring are separate parts, i.e., non-integral, they may be formed as one integral part if desired. However, as will be seen later, this means that the burner cannot remain in place suspended within the base opening, when the burner is being refilled with fuel.

The wick 34 extends upwardly from the cap opening 65, where the exposed upper free end 71 of the wick 32 is burned. The cap opening 65 is sized to frictionally hold the wick 34 in place and prevent it from falling downward into the interior of the burner assembly, yet not so tight that the length of the wick 34 cannot be manually adjusted as necessary. The wick 34 is made of inorganic material such as fiberglass or organic or natural material such as cotton or a combination of cotton and fiberglass. The combination of cotton and fiberglass is preferable since it has the capillary action of cotton as well as the longevity of fiberglass.

With the oil burner so constructed, the bladders 50 and 51, when empty, may be collapsed and inserted along with the lower end of the tube 27 and the lower flange ring 47 into the opening 22 of the base structure 21 until the top collar flange ring 31 rests on the top surface 20 surrounding the opening 22 so that it is suspended therein. The ring 31 can be glued or otherwise secured to the base 21 as desired to make it permanent, or it may be left loose so that the burner assembly may be removed as desired. It should be understood that the base opening 22 should be smaller than top collar flange ring 31 but larger than the oil burner parts below the flange ring 31 so that the burner can be inserted and suspended within the opening 22. The parts of the burner assembly can be of any size necessary for a particular application. Typically, the inner tube 36 is approximately 1-½ inches long, has an inner diameter of at least ⅛ inch to permit placement the wick 34 therewithin, and an outer diameter on the order of ⅜ to ½ inch.

To fill the fuel reservoir 25 with oil, the cap 32 is unscrewed and removed. The wick 34 may be removed or left in the tube depending on how the user is filling the burner. The reservoir is then filled with fuel and the cap 32 replaced. After the cap 32 is replaced, the wick 34 should extend upwardly slightly from the cap 32 and downwardly into the oil. Any excess length of wick 34 can be left at the bottom of the internal bladder as shown at 72. These operations can be done with the burner assembly left in place in the statue or base.

Figure 2:
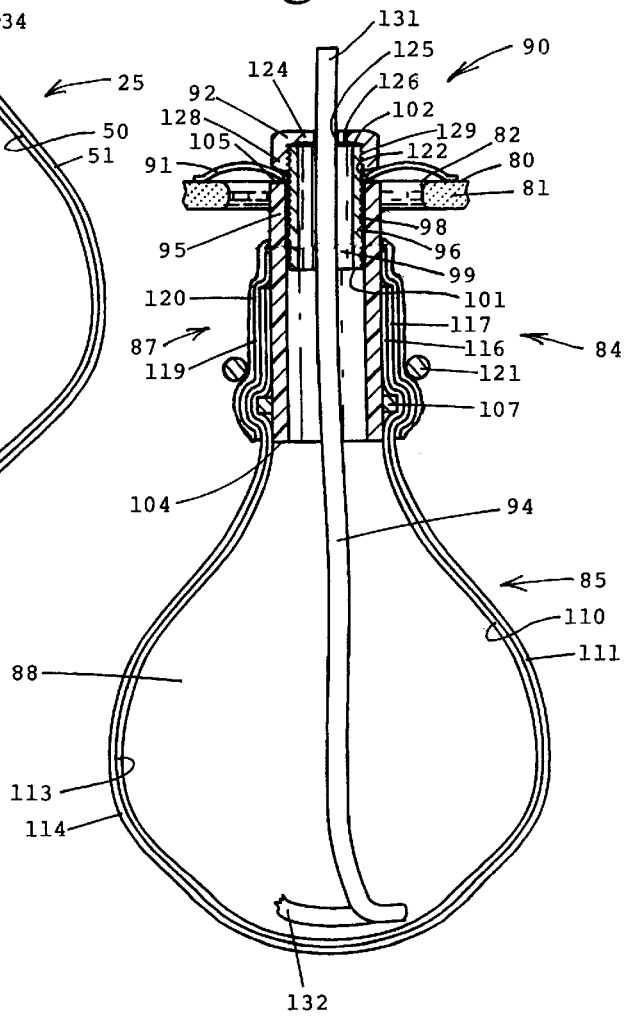
FIG. 2 is a cross-sectional view of a second embodiment of a burner constructed in accordance with the present invention.

Referring to FIG. 2, the generally horizontal top surface 80 of a statuary base 81 has an opening 82 into which the oil burner and fuel container assembly, generally designated 84, is inserted and suspended. The oil burner 84 includes a container, generally designated 85, for holding combustible fluid, a tube, generally designated 87, communicating with the interior 88 of the container 85 and extending upwardly therefrom, a top collar, generally designated 90, including an upper collar flange ring 91 extending radially outward from the tube 87 and spaced downwardly from the upper end of the tube 87 and a cap 92 secured to the top of the tube, and a wick 94 extending from the interior 88 of the container 85, through the tube 87 and the cap 92 and outward above the cap 92.

The tube 87 is made up of an elongate, cylindrical plastic outer tube 95 and an elongate, cylindrical metal inner tube 96 positioned coaxially within the outer tube 95. The inner tube 96 has an external helical thread 98 and an internal passage 99 extending axially from its lower end 101 to its upper end 102. The external thread 98 of the inner tube 96 engages the inner wall of the outer tube 95 to hold it in place with its upper end 102 extending upward from the upper end 105 of outer tube 95. A lower flange ring 107 is press fit around the outer tube 95 adjacent its lower end 104. As will be seen later herein, the lower flange ring 107 acts as an attachment means to grip the fuel container 85 and prevent it from slipping off the tube 95.

The fuel container 85, or lamp oil reservoir, is defined by internal and external collapsible bladders, designated 110 and 111, respectively. The bladders 110 and 111 each have a globe portion, 113 and 114, respectively, and a neck portion, 116 and 117, respectively, extending from their respective globe portions 113 and 114. During assembly of the oil burner, the internal bladder 110 is positioned so that its neck portion 116 is situated around the outer tube 95 with the upper end of the neck portion 116 situated between the flange ring 107 and the upper end 105 of the outer tube 95. The external bladder 111 is positioned so that the internal bladder 110 is located therewithin with the neck portion 117 of the external bladder 111 surrounding the neck portion 116 of the internal bladder 110.

With the bladders 110 and 111 in place on the tube 95, the tube 95 and the bladder neck portions 116 and 117 are spirally wrapped with a band of overlying insulating tape 119 from a point above the bladder neck portions 116 and 117 to a point below the flange ring 107. After the bladders 110 and 111 are tightly wrapped in place, a band of overlying heat shrink tubing 120 is placed over the insulating tape 119. The tubing 120 extends upwardly and downwardly from the upper and lower extents of the tape 119. The tubing 120 is shrunk in place with heat so that the assembly is secured around the lower flange ring 107 and neatly finished. The ring 107 keeps the bladders 110 and 111 from sliding downwardly off the end of the tube 95. The ring 107 can be integrally formed flange on the outer tube or grooves, shoulders, knurls or similar structure carried by the outer tube. To further insure that the bladders do not slip past the flange 107 and off the tube 95, an annular wire clamp 121 is tightly wrapped around all the overlying layers above the flange 107.

The upper flange ring 91 of the collar 90 is a curved, cylindrical metal piece, or spring washer, with a central annular opening 122, the thickness of the washer and the size of the annular opening 122 are of such size to engage the external thread 98 of the inner tube 96 so that it may be screwed thereon. The cap 92 is defined by a radially extending upper wall 124 with a central opening 125 for the wick 94 and a vent hole 126, an annular skirt 128 connected to the periphery of the upper wall 124 and extending downward relative to the upper wall 124, and an internal thread 129 formed on the inward cylindrical wall of the skirt 128 adapted to cooperatively engage the exposed external thread 98 adjacent the upper end of the inner tube 96. The cap 92 may take the form of a hex cap nut with a six-sided skirt. The cap 92 is not as tall, i.e., the skirt 128 is not as long, as the 32 cap shown in FIG. 1. If a washer is used which did not securely engage the tube thread, the cap skirt 128 holds the washer in place.

The wick 94 extends upwardly from the cap opening 125, where the exposed upper free end 131 of the wick 94 is burned. The cap opening 125 is sized to frictionally hold the wick 94 in place and prevent it from falling downward into the interior of the burner assembly, yet not so tight that the length of the wick 94 cannot be manually adjusted as necessary.

With the oil burner so constructed, the bladders 110 and 111, when empty, may be collapsed and inserted along with the lower end of the tube 87 and the lower flange ring 107 into the opening 82 of the base structure 81 until the top collar flange ring 91 rests on the top surface 80 surrounding the opening 82 so that it is suspended therein. The ring 91 can be glued or otherwise secured to the base 81 as desired to make it permanent, or it may be left loose so that the burner assembly may be removed as desired.

Figure 3:
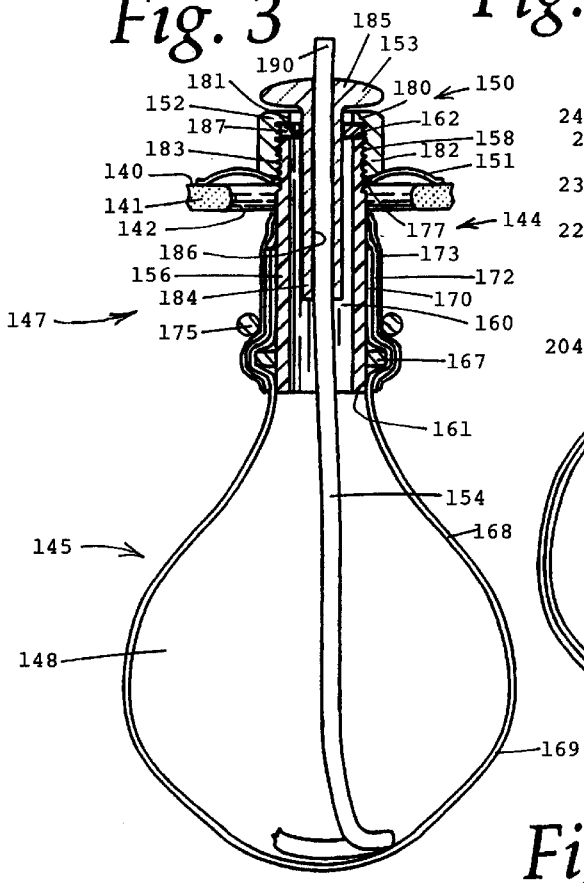
FIG. 3 is a cross-sectional view of a third embodiment of a burner constructed in accordance with the present invention.

Referring to FIG. 3, the generally horizontal top surface 140 of a statuary base 141 has an opening 142 into which the oil burner and fuel container assembly, generally designated 144, is inserted and suspended. The oil burner includes a container, generally designated 145, for holding combustible fluid, a tube, generally designated 147, communicating with the interior 148 of the container 145 and extending upwardly therefrom, a top collar, generally designated 150, including an upper collar flange ring 151 extending radially outward from the tube 147 and spaced downwardly from the upper end of the tube 147 and a cap 152 secured to the top of the tube 147 carrying a wick holder 153, and a wick 154 extending from the interior 148 of the container 145, through the tube 147 and the wick holder 153 and outward above the cap 152.

The tube 147 is made up of an elongate, cylindrical plastic tube 156 having an external helical thread 158 adjacent its upper end 162, and an internal passage 160 extending axially from its lower end 162 to its upper end 161. A lower flange ring 167 is press fit around the tube 156 adjacent its lower end 161. As will be seen later herein, the lower flange ring 167 acts as an attachment means to grip the fuel container 145 and prevent it from slipping off the tube 156.

The fuel reservoir 145, or lamp oil reservoir, is formed from a collapsible bladder 168. The bladder 168 has a globe portion 169 and a neck portion 170 extending from the globe portion 169. During assembly of the oil burner, the bladder 168 is positioned so that its neck portion 170 is situated around the tube 156 with the upper end of the neck portion 170 situated between the flange ring 167 and the upper end 162 of the tube 156.

With the bladder 168 in place on the tube 156, the tube 156 and the bladder neck portion 170 are spirally wrapped with a band of overlying insulating tape 172 from a point above the bladder neck portion 170 to a point below the flange ring 167. After the bladder 168 is tightly wrapped in place, a band of overlying heat shrink tubing 173 is placed over the insulating tape 172 and extends upwardly and downwardly from the upper and lower extents of the tape 172. The tubing 173 is shrunk in place with heat so that the assembly is secured around the lower flange ring 167 and neatly finished. The ring 167 keeps the bladder 168 from sliding downwardly off the end of the tube 156. The ring 167 can be replaced by an integrally formed flange on the outer tube or by grooves, shoulders, knurls or similar structure carried by the outer tube. To further insure that the bladder does not slip past the flange 167 and off the tube 156, an annular wire clamp 175 is tightly wrapped around all the overlying layers above the flange 167.

The upper flange ring 151 of the collar 150 is a curved, cylindrical metal piece, or spring washer, with a central annular opening 177, the thickness of the washer and the size of the annular opening are of such size to engage the external thread 158 of the tube 156 so that it may be threaded thereon. The cap 152 is defined by a radially extending upper wall 180 with a central opening 181, an annular skirt 182 connected to the periphery of the upper wall 180 and extending downward relative to the upper wall 180, and an internal thread 183 formed on the inward cylindrical wall of the skirt 182 adapted to cooperatively engage the exposed external thread 158 adjacent the upper end 162 of the tube 156. The cap 152 may take the form of a hex cap nut with a six-sided skirt.

Figure 3A:
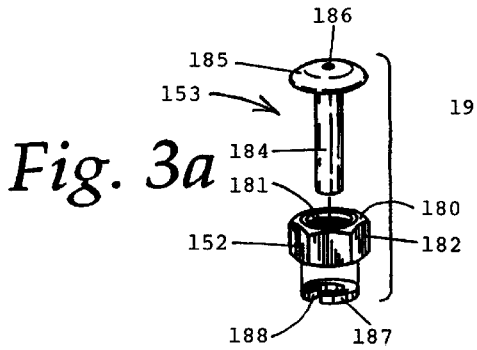
FIG. 3*a* is an exploded, perspective view of the glass wick holder assembly shown in FIG. 3.

As seen in FIG. 3, and more particularly in FIG. 3*a,* the glass wick holder 153 has an elongate tubular part 184 extending through the cap opening 181, an enlarged top part 185, and an internal passage 186 extending axially from the top to the bottom thereof through which the wick 154 passes and is frictionally held. A resilient split washer 187 is positioned between the underside of the cap 152 and the top edge of the tube 156. When the cap 152 is tightened down onto the tube 156, the washer 187 grips the side of the tubular part 184 of the glass wick holder 153 to hold it in position and prevent it from slipping out. The small gap 188 (see FIG. 3*a*) in the split washer 187 acts as a vent hole to permit ambient air to enter the container 145 as fuel is consumed. The enlarged top part 185 prevents the wick holder 153 from being pushed into the pass the cap 152 and into the tube 156. Since the wick holder 153 is made of glass it acts as a heat insulator between the burning wick end 190 which extends upward from the wick holder 153 and the remainder of the burner assembly below.

Figure 3B:
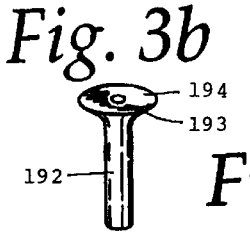
FIG. 3*b* is an perspective view of an alternative glass wick holder for that shown in FIGS. 3 and 3*a;*
Figure 3C:
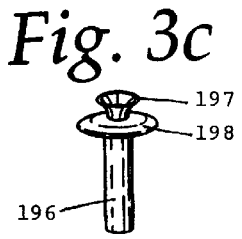
FIG. 3*c* is an perspective view of a second alternative glass wick holder for that shown in FIGS. 3 and 3*a;*

FIGS. 3*b* and 3*c* show other forms of glass wick holders. In FIG. 3*b,* the glass wick holder 192 has a top part 193 with a flat top surface 194. In FIG. 3*c,* the glass wick holder 196 has an upright part 197 extending upward from the enlarged top part 198.

Figure 4:
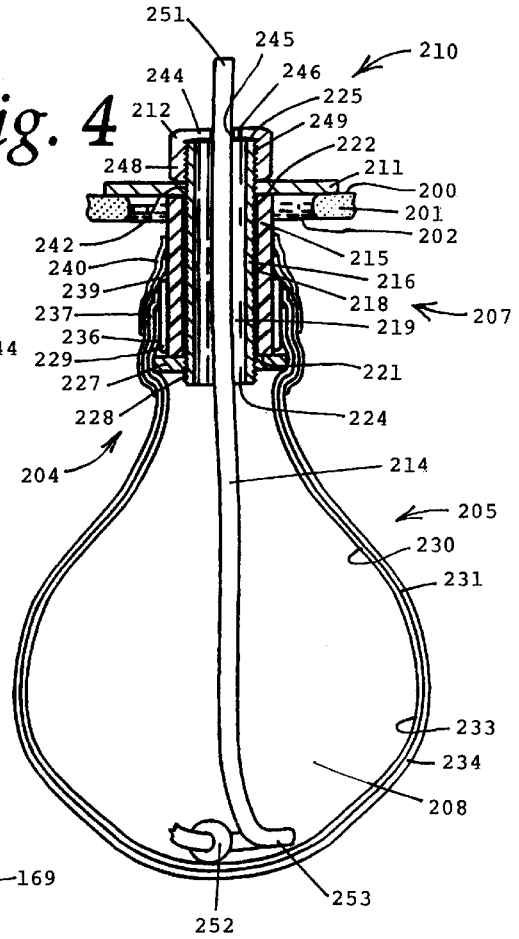
FIG. 4 is a cross-sectional view of a fourth embodiment of a burner constructed in accordance with the present invention.

Referring to FIG. 4, the generally horizontal top surface 200 of a statuary base 201 has an opening 202 into which the oil burner and fuel container assembly, generally designated 204, is inserted and suspended. The oil burner 204 includes a container, generally designated 205, for holding combustible fluid, a tube, generally designated 207, communicating with the interior 208 of the container 205 and extending upwardly therefrom, a top collar, generally designated 210, including an upper collar flange ring 211 extending radially outward from the tube 207 and spaced downwardly from the upper end of the tube 207 and a cap 212 secured to the top of the tube 207, and a wick 214 extending from the interior 208 of the container 205, through the tube 207 and the cap 212 and outward above the cap 212.

The tube 207 is made up of an elongate, cylindrical plastic outer tube 215 and an elongate, cylindrical metal inner tube 216 positioned coaxially within the outer tube 215. The inner tube 216 has an external helical thread 218 and an internal passage 219 extending axially from its lower end 221 to its upper end 222. The longer inner tube 216 extends downward from the lower end 224 and upward from the upper end 225 of the shorter outer tube 215. A lower flange ring 227, which may be replaced by a nut or washer, having an internal helical thread 228 is screwed onto the exposed lower of the inner tube 216 to a position adjacent the lower end 221 abutting the lower end 221 of the outer tube 215. The lower flange ring 227 acts as an attachment means to grip the fuel container 205 and prevent it from slipping off the tube 215.

As seen in FIG. 4, a band of an overlying insulating tube 229 is positioned around the outer tube 215 above the lower flange ring 227. The insulating tube 229 is made of fiberglass insulation capable of resisting 1200 degrees F. If the threaded tube overheats, damage to the bladders 230 and 231 or the heat shrink tubing 240 is prevented. Similarly, when the heat shrink tubing 240 is applied and heated, as by a heat gun, the insulating tape 239 protects the bladders 230 and 231, the insulating tape 239 being capable of resisting 500 degrees F.

The fuel container 205, or lamp oil reservoir, is formed from a internal and external collapsible bladders, designated 230 and 231, respectively. The bladders 230 and 231 each have a globe portion, 233 and 234, respectively, and a neck portion, 236 and 237, respectively, extending from their respective globe portions 233 and 234. During assembly of the oil burner, the internal bladder 230 is positioned so that its neck portion 236 is situated around the outer tube 215 over the insulating tube 229 with the upper end of the neck portion 216 situated between the flange ring 227 and the upper end 225 of the outer tube 215. The external bladder 231 is positioned so that the internal bladder 230 is located therewithin with the neck portion 237 of the external bladder 231 surrounding the neck portion 236 of the internal bladder 230.

With the bladders 230 and 231 in place on the tube 215, the tube 215 and the bladder neck portions 236 and 237 are spirally wrapped with a band of overlying insulating tape 239 from a point above the bladder neck portions 236 and 237 to a point below the flange ring 227. After the bladders 230 and 231 are tightly wrapped in place, a band of overlying heat shrink tubing 240 is placed over the insulation tape 239. The tubing 240 is shrunk in place with heat so that the assembly is secured and neatly finished. The ring 227 keeps the bladders from sliding downwardly off the end of the tube 215. The ring 227 can be an integrally formed flange on the outer tube or grooves, shoulders, knurls or similar structure carried by the outer tube.

The upper flange ring 211 of the collar 210 is a flat, cylindrical metal piece, or washer, with a central annular opening having an internal thread 242 adapted to cooperatively engage the exposed external thread 218 adjacent the upper end 222 of the inner tube 216 to fix it thereto. The flange ring 211 is threaded downwardly onto the top of the inner tube 216 until it abuts the upper end 225 of the outer tube 215 so that the inner tube 216 is axially fixed within the outer tube 215.

The cap 212 is defined by a radially extending upper wall 244 with a central opening 245 for the wick 214 and a vent hole 246, an annular skirt 248 connected to the periphery of the upper wall 244 and extending downward relative to the upper wall 244, and an internal thread 249 formed on the inward cylindrical wall of the skirt 248 adapted to cooperatively engage the exposed external thread 218 adjacent the upper end 222 of the inner tube 216. The cap 212 may take the form of a hex cap nut with a six-sided skirt.

The wick 214 extends upwardly from the cap opening 245, where the exposed upper free end 251 of the wick 214 is burned. The cap opening 245 is sized to frictionally hold the wick 214 in place and prevent it from falling downward into the interior of the burner assembly, yet not so tight that the length of the wick 214 cannot be manually adjusted as necessary. An anchoring weight 252 is attached to the lower end 253 of the wick 214 to keep the wick 214 at the bottom of the container 205 within the fuel should the wick 214 tend to float or should the fuel level be low.

Referring to FIG. 15, the generally horizontal top surface 260 of a statuary base 261 has an opening 262 into which the oil burner and fuel container assembly, generally designated 264, is inserted and suspended. The oil burner 264 includes a container 265 for holding combustible fluid, a tube, generally designated 267, communicating with the interior 268 of the container 265 and extending upwardly therefrom, a top collar, generally designated 270, including an upper collar flange ring 271 extending radially outward from the tube 267 and spaced downwardly from the upper end of the tube 267 and a cap 272 secured to the top of the tube 267, and three wicks, collectively designated 274, extending from the interior 268 of the container 265, through the tube 267 and the cap 272 and outward above the cap 272.

The tube 267 is made up of an elongate, cylindrical plastic outer tube 275 and an elongate, cylindrical metal inner tube 276 positioned coaxially within the outer tube 275. The inner tube 276 has an external helical thread 278 and an internal passage 279 extending axially from its lower end 281 to its upper end 282. The external thread 278 of the inner tube 276 engages the inner wall of the outer tube 275 to hold it in place with the upper end 282 of the inner tub 276 extending upward from the upper end 285 of the outer tube 275. A lower flange ring 287 is press fit around the outer tube 275 adjacent its lower end 284. As will be seen later herein, the lower flange ring 287 acts as an attachment means to grip the fuel container 265 and prevent it from slipping off the tube 275.

The fuel container 265, or lamp oil reservoir, is formed from a internal and external collapsible bladders, designated 290 and 291, respectively. The bladders 290 and 291 each have a globe portion, 293 and 294, respectively, and a neck portion, 296 and 297, respectively, extending from their respective globe portions 293 and 294. During assembly of the oil burner, the internal bladder 290 is positioned so that its neck portion 296 is situated around the outer tube 275 with the upper end of its neck portion 296 situated between the flange ring 287 and the upper end 285 of the outer tube 275. The external bladder 291 is positioned so that the internal bladder 290 is located therewithin with the neck portion 297 of the external bladder 291 surrounding the neck portion 296 of the internal bladder 290.

With the bladders 290 and 291 in place on the tube 275, the tube 275 and the bladder neck portions 296 and 297 are spirally wrapped with a band of overlying insulating tape 299 from a point above the bladder neck portions to a point below the flange ring. After the bladders 296 and 297 are tightly wrapped in place, a band of overlying heat shrink tubing 300 is placed over the insulating tape 299 and extends upwardly and downwardly from the upper and lower extents of the tape 299. The tubing 300 is shrunk in place with heat so that the assembly is secured around the lower flange ring 287 and neatly finished. The ring 287 keeps the bladders 290 and 291 from sliding downwardly off the end of the tube 275.

The upper flange ring 271 of the collar 270 is a flat, cylindrical metal piece, or washer, with a central annular opening having an internal thread 302 adapted to cooperatively engage the external thread 278 adjacent the upper end 282 of the inner tube 276 to fix it thereto. The flange ring 271 is threaded downwardly onto the upper end 282 of the inner tube 276 until it abuts the upper end 285 of the outer tube 275 so that the inner tube 276 is axially fixed within the outer tube 275.

The cap 272 is defined by a radially extending upper wall 304 with three openings, one of which is designated 305, one for each of the three wicks 274 and a vent hole 306, an annular skirt 308 connected to the periphery of the upper wall 304 and extending downward relative to the upper wall 304, and an internal thread 309 formed on the inward cylindrical wall of the skirt 308 adapted to cooperatively engage the exposed external thread 278 adjacent the upper end 285 of the inner tube 276. The cap 272 may take the form of a hex cap nut with a six-sided skirt.

The three wicks 274 extend upwardly from the respective cap openings 305, where the exposed upper free ends of the wicks are burned. The cap openings 305 are sized to frictionally hold the wicks 274 in place and prevent them from falling downward into the interior 268 of the burner assembly, yet not so tight that the length of the wicks 274 cannot be manually adjusted as necessary.

In FIG. 6, an oil burner 310 is shown used in a statue modeling a church 311 and is suspended at the top of the steeple 312. The burner collar 314 rests on the top thereof with the fuel container 315 suspended in the hollow steeple 312 and hidden from view.

In FIG. 7, a large number of oil burners, one of which is designated 320, are suspended at the top and in the various side extensions, one of which is designated 321, of a pyramid-shaped candle tree 322. The top of the tree and each of the side extensions 321 has a flat upper surface 324 on which the burner collar 325 rests. The tree 322 and the side extensions 321 are hollow to hold the various fuel containers 327. Thus, it can be seen that any number of burners and bladders can be incorporated into a single statue.

In FIG. 8, an oil burner 330 replaces part of a torch 331 held aloft by the right hand 333 of a statue 334 resembling the "Statue of Liberty". The top 336 of the torch is flat to support the burner collar 337 with the fuel container 338 hidden within the upraised hollow arm 339. Herein, the hollow arm 339 is a separate piece and is attached by suitable means to the remainder of the statue 334.

In FIG. 9, an oil burner 340, shown in phantom within the statue, is suspended from the fireplace 341 at the base of a chimney 342 in a small replica of a room, which has a model of a Christmas tree 344, a rocking chair 345 and a side table 346. The logs 347 in the fireplace 341 are movable and hide the burner wick (not shown), which burns with a flame, which is designated 348.

In FIG. 10, three oil burners 350*a,* 350*b* and 350*c,* are placed within a common base 351, which is the rectangular table part of a statue depicting the Apostles attending the "Last Supper." The bottom of the table has an opening 352 to allow access to the hollow interior of the base 351. This permits replacement of the fuel containers 354*a,* 354*b* and 354*c,* if the collars 355*a,* 355*b* and 355*c* of the respective burners 350*a,* 350*b* and 350*c* are fixed to the top 357 of the table.

In FIG. 5, a different version of the invention is shown. Herein, a fanciful candelabra statue 360 has nine lands, one of which is designated 361, upraised from the top surface 362 and respectively supporting one of nine burners, one of which is designated 364, which are all attached to a common bladder 365. The bladder 365 is formed with nine extending neck portions, one of which is designated 366, to which the burner tubes are attached. Herein, the opening 367 in the statue bottom permits assembly of the burners 364 within the statue 360. Thus, it can be seen that any number of burners can draw combustible fuel from a single bladder.

Figure 11:
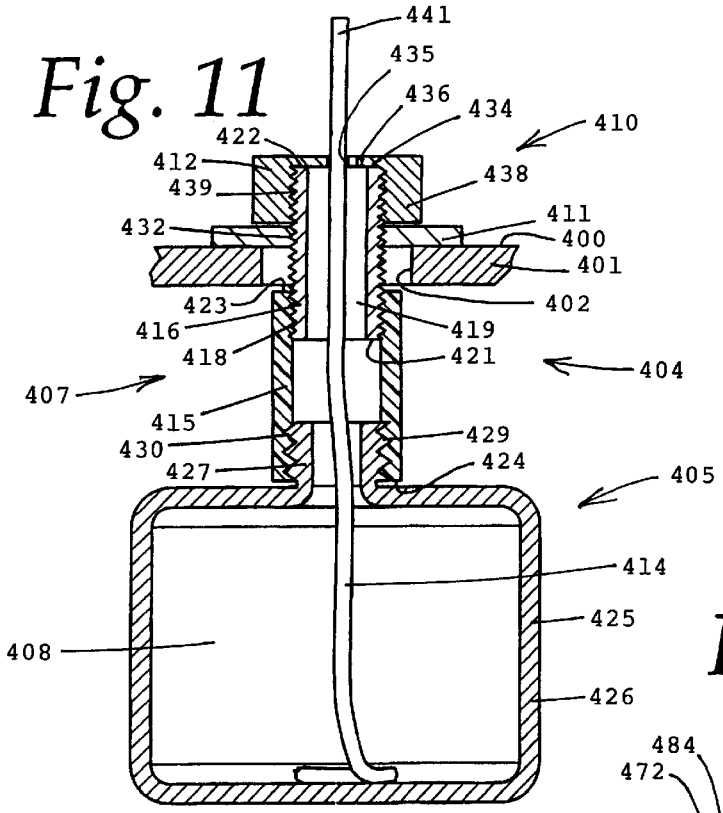
FIG. 11 is a cross-sectional view of another embodiment of a burner constructed in accordance with the present invention.

Referring to FIG. 11, the generally horizontal top surface 400 of a statuary base 401 has an opening 402 into which the oil burner and fuel container assembly, generally designated 404, is suspended. The oil burner 404 includes a container 405 for holding combustible fluid, a tube, generally designated 407, communicating with the interior 408 of the container 405 and extending upwardly therefrom, a top collar, generally designated 410, including a flange ring 411 extending radially outward from the tube 407 and spaced downwardly from the upper end of the tube 407 and a cap 412 secured to the top of the tube 407, and a wick 414 extending from the interior of the container 405, through the tube 407 and the cap 412 and outward above the cap 412.

The tube 407 is made up of an elongate, cylindrical plastic outer tube 415 and an elongate, cylindrical metal inner tube 416 positioned coaxially within the outer tube 415. The inner tube 416 has an external helical thread 418 and an internal passage 419 extending axially from its lower end 421 to its upper end 422. The external thread 418 of the inner tube 416 engages the inner wall of the outer tube 415 to hold it in place with the upper end 416 of the inner tube 416 extending upward from the upper end 423 of the outer tube 415.

The container 405, or lamp oil reservoir, is a glass or plastic bottle 425 having a main portion 426 and a neck portion 427 with an external helical thread 429. The outer tube 415 has an internal helical thread 430 adjacent its lower end 424 adapted to engage the bottle neck thread 429 and hold the bottle 425 at the bottom of the outer tube 415. Because the bottle 425 is larger than the opening 402 in the base 401, the burner 404 is attached to the statue from below.

The upper flange ring 411 of the collar 410 is a flat, cylindrical metal piece, or washer, with a central annular opening having an internal thread 432 adapted to cooperatively engage the external thread 418 adjacent the upper end 422 of the inner tube 416 to fix it thereto. The flange ring 411 rests on the upper surface 400 of the base 401 thereby suspending the burner 404 within the opening 402.

The cap 412 is defined by a radially extending upper wall 434 with a central opening 435 for the wick 414 and a vent hole 436, an annular skirt 438 connected to the periphery of the upper wall 434 and extending downward relative to the upper wall 434, and an internal thread 439 formed on the inward cylindrical wall of the skirt 438 adapted to cooperatively engage the exposed external thread 418 adjacent the upper end 422 of the inner tube 416. The cap 412 may take the form of a hex cap nut with a six-sided skirt.

The wick 414 extends upwardly from the cap opening 435, where the exposed upper free end 441 of the wick 414 is burned. The cap opening 435 is sized to frictionally hold the wick 414 in place and prevent it from falling downward into the interior of the burner assembly, yet not so tight that the length of the wick 414 cannot be manually adjusted as necessary.

Figure 12:
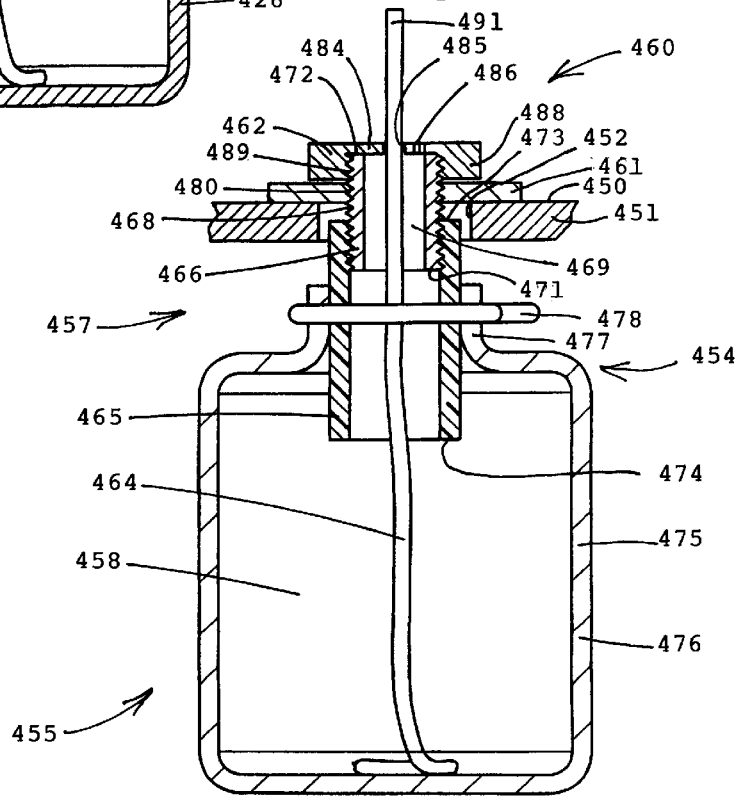
FIG. 12 is a cross-sectional view of another embodiment of a burner constructed in accordance with the present invention.

Referring to FIG. 12, the generally horizontal top surface 450 of a statuary base 451 has an opening 452 into which the oil burner and fuel container assembly, generally designated 454, is suspended. The oil burner 454 includes a container 455 for holding combustible fluid, a tube, generally designated 457, communicating with the interior 458 of the container 455 and extending upwardly therefrom, a top collar, generally designated 460, including an upper collar flange ring 461 extending radially outward from the tube 457 and spaced downwardly from the upper end of the tube 457 and a cap 462 secured to the top of the tube 457, and a wick 464 extending from the interior 458 of the container 455, through the tube assembly and the cap and outward above the cap.

The tube 457 is made up of an elongate, cylindrical plastic outer tube 465 and an elongate, cylindrical metal inner tube 466 positioned coaxially within the outer tube 465. The inner tube 466 has an external helical thread 468 and an internal passage 469 extending axially from its lower end 471 to its upper end 472. The external helical thread 468 of the inner tube 466 engages the inner wall of the outer tube 465 to hold it in place with the upper end 472 of the inner tube 466 extending upward from the upper end 473 of the outer tube 465.

The container 455, or lamp oil reservoir, is a flexible plastic bottle 475 having a main portion 476 and a neck portion 477. The outer diameter of the outer tube 465 and the inner diameter of the bottle neck portion 477 are sized so that the bottle 477 can be positioned tightly onto the tube 465 as by a press fit. An annular clamp 478, such as a hose clamp, overlying the bottle neck portion 477 can be used to hold the bottle 475 securely around the tube 465.

The upper flange ring 461 of the collar 460 is a flat, cylindrical metal piece, or washer, with a central annular opening having an internal thread 480 adapted to cooperatively engage the external thread 468 adjacent the upper end 472 of the inner tube 466 to fix it thereto. The flange ring 461 rests on the upper surface 450 of the base 451 thereby suspending the burner assembly 454 within the opening.

The cap 462 is defined by a radially extending upper wall 484 with a central opening 485 for the wick 464 and a vent hole 486, an annular skirt 488 connected to the periphery of the upper wall 484 and extending downward relative to the upper wall 484, and an internal thread 489 formed on the inward cylindrical wall of the skirt 488 adapted to cooperatively engage the exposed external thread 468 adjacent the upper end 472 of the inner tube 466.

The wick 464 extends upwardly from the cap opening 485, where the exposed upper free end 491 of the wick 464 is burned. The cap opening 485 is sized to frictionally hold the wick 464 in place and prevent it from falling downward into the interior of the burner assembly.

Figure 13:
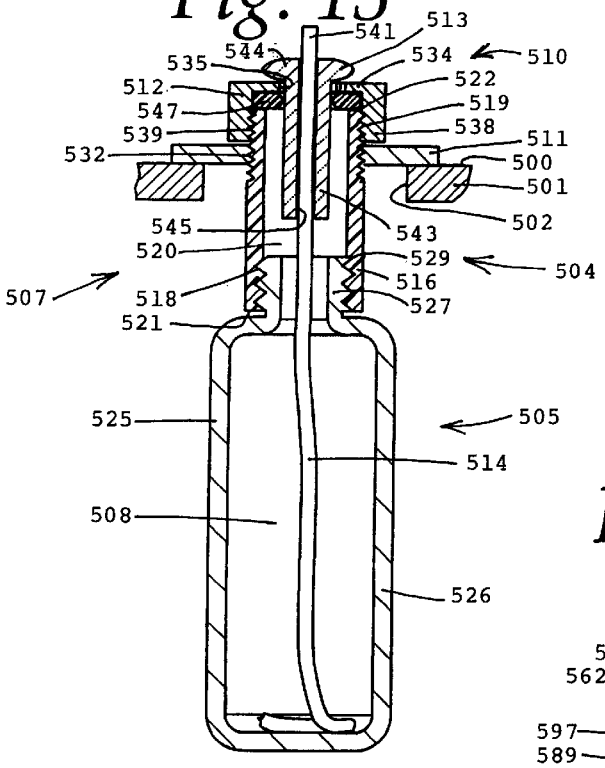
FIG. 13 is a cross-sectional view of another embodiment of a burner constructed in accordance with the present invention.

Referring to FIG. 13, the generally horizontal top surface 500 of a statuary base 501 has an opening 502 into which the oil burner and fuel container assembly, generally designated 504, is suspended. The oil burner 504 includes a container 505 for holding combustible fluid, a tube, generally designated 507, communicating with the interior 508 of the container 505 and extending upwardly therefrom, a top collar, generally designated 510, including an upper collar flange ring 511 extending radially outward from the tube 507 and spaced downwardly from the upper end of the tube 507 and a cap 512 secured to the top of the tube 507 carrying a wick holder 513, and a wick 514 extending from the interior of the container 505, through the tube 507 and the wick holder 513 and outward above the cap 512.

The tube 507 is made up of an elongate, cylindrical plastic tube 516 having an internal helical thread 518 adjacent its lower end 521, an internal helical thread 519 adjacent its upper end 522, and an internal passage 520 extending axially from its lower end 521 to its upper end 522.

The container 505, or lamp oil reservoir, is a tall, thin, glass or plastic bottle 525 having a main portion 526 and a neck portion 527 with an external helical thread 529. The tube internal helical thread 519 is adapted to cooperatively engage the bottle neck thread 529 and hold the bottle 525 at the bottom of the tube 516. Because the bottle 525 is smaller than the opening 502 in the base 501, the burner may be inserted downwardly into the base opening 502 so that it is suspended therein.

The upper flange ring 511 of the collar 510 is a flat, cylindrical metal piece, or washer, with a central annular opening having an internal thread 532 adapted to cooperatively engage the external thread 518 adjacent to the upper end 522 of the tube 516 to fix it thereto. The flange ring 511 rests on the upper surface 500 of the base 501 thereby suspending the burner assembly within the opening 502.

The cap 512 is defined by a radially extending upper wall 534 with a central opening 535, an annular skirt 538 connected to the periphery of the upper wall 534 and extending downward relative to the upper wall 534, and an internal thread 539 formed on the inward cylindrical wall of the skirt 538 adapted to cooperatively engage the exposed external thread 518 adjacent the upper end 522 of the tube 516.

The glass wick holder 513 has an elongate tubular part 543 extending through the cap opening 535, an enlarged top part 544, and an internal passage 545 extending axially from the top to the bottom thereof through which the wick 514 passes and is frictionally held. A resilient split washer 547 is positioned between the underside of the cap 512 and the top edge of the tube 516. When the cap 512 is tightened down onto the tube 516, the washer 547 grips the tubular part 543 of the glass wick holder 513 to hold it in position and prevent it from slipping out. A small gap in the washer (see FIG. 3*a*) acts as a vent hole to permit ambient air to enter the container as fuel is consumed. The enlarged top part 544 prevents the wick holder 513 from being pushed past the cap 512 and into the tube 516. Since the wick holder 513 is made of glass it acts as a heat insulator between the burning wick end 541 which extends upward from the wick holder 513 and the remainder of the burner assembly below.

Figure 14:
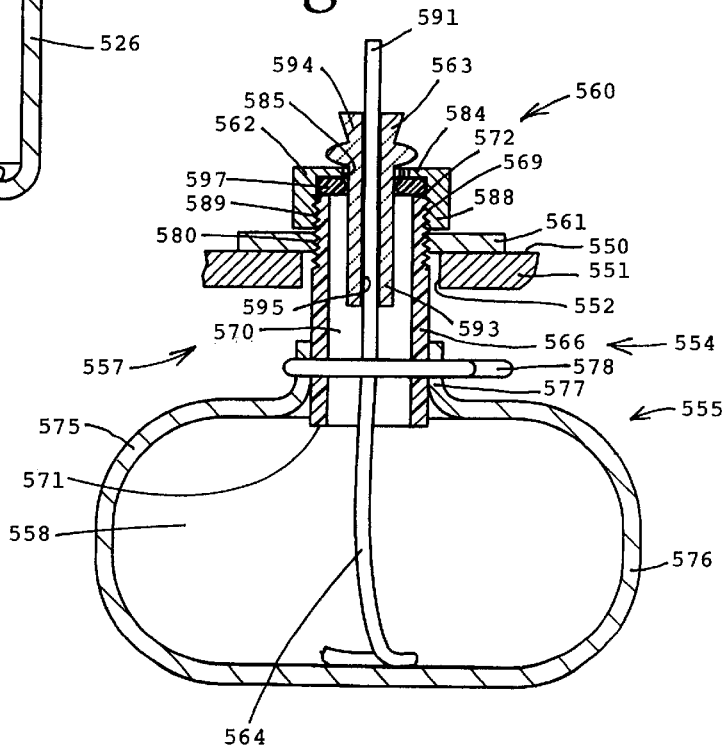
FIG. 14 is a cross-sectional view of another embodiment of a burner constructed in accordance with the present invention; and, FIG. 15 is a cross-sectional view of another embodiment of a burner constructed in accordance with the present invention and having three wicks.

Referring to FIG. 14, the generally horizontal top surface 550 of a statuary base 551 has an opening 552 into which the oil burner and fuel container assembly, generally designated 554, is suspended. The oil burner 554 includes a container 555 for holding combustible fluid, a tube, generally designated 557, communicating with the interior 558 of the container 555 and extending upwardly therefrom, a top collar, generally designated 560, including an upper collar flange ring 561 extending radially outward from the tube 557 and spaced downwardly from the upper end of the tube 557, and a cap 562 secured to the top of the tube 557 carrying a wick holder 563, and a wick 564 extending from the interior of the container 555, through the tube 557 and the wick holder 563 and outward above the cap 562.

The tube 557 is made up of an elongate, cylindrical plastic tube 566 having an external helical thread 569 adjacent its top end 572 and an internal passage 570 extending axially from its lower end 571 to its upper end 572.

The container 555, or lamp oil reservoir, is a flexible plastic bottle 575 having a main portion 576 and a neck portion 577. The outer diameter of the tube 566 and the inner diameter of the bottle neck portion 577 are sized so that the bottle 575 can be positioned tightly onto the tube 566. An annular clamp 578, such as a hose clamp, overlying the bottle neck portion 577 can be used to hold the bottle 575 securely around the tube 566.

The upper flange ring 561 of the collar 560 is a flat, cylindrical metal piece, or washer, with a central annular opening having an internal thread 580 adapted to cooperatively engage the exposed external thread 569 adjacent the upper end 572 of the tube 566 to fix it thereto. The flange ring 561 rests on the upper surface 550 of the base 551 thereby suspending the burner assembly within the opening 552.

The cap 562 is defined by a radially extending upper wall 584 with a central opening 585, an annular skirt 588 connected to the periphery of the upper wall 584 and extending downward relative to the upper wall 584, and an internal thread 589 formed on the inward cylindrical wall of the skirt 588 adapted to cooperatively engage the exposed external thread 569 adjacent the upper end 572 of the tube 566.

The glass wick holder 563 has an elongate tubular part 593 extending through the cap opening 585, an enlarged top part 594, and an internal passage 595 extending axially from the top to the bottom thereof through which the wick 564 passes and is frictionally held. A resilient split washer 597 is positioned between the underside of the cap 562 and the top edge of the tube 566. When the cap 562 is tightened down onto the tube 566, the washer grips the tubular part 593 of the glass wick holder 563 to hold it in position and prevent it from slipping out. A small gap in the washer (see FIG. 3*a*) acts as a vent hole to permit ambient air to enter the container 555 as fuel is consumed. The enlarged top part 594 prevents the wick holder 563 from being pushed past the cap 562 and into the tube 566. Since the wick holder 563 is made of glass it acts as a heat insulator between the burning wick end 564 which extends upward from the wick holder 563 and the remainder of the burner assembly below.

Industrial Applicability

From the foregoing, it should be apparent the liquid fuel burner described herein is simple, compact and inexpensive, yet provides a convenient and reliable means for delivering a pleasing flame from a liquid fuel source.

The burner assembly structure described herein can be varied in many ways. Some of the structures are explicitly shown, but as described herein, variations can be made which are intended herein to be substantial equivalents of the applicant' liquid fuel burner assembly. For example, a glass wick holder can be used in a burner employing multiple bladders; or, the washer and cap type and be interchanged among the designs; or, the clamp wire can be utilized or not as necessary; or, the fuel bottle shape may be switched or changed among the various designs.

Other aspects, objects and advantages of this invention can be obtained from a study of the drawings, the disclosure and the appended claims.

What is claimed is:

1. A liquid fuel burner with a wick and a fuel storage container adapted to be inserted into an opening in a supporting base, the burner comprising:

a tube having upper and lower ends with an internal passage extending axially between said upper and lower ends, said tube having a helical thread adjacent its upper end, the fuel container being mounted to said tube adjacent the lower end thereof, the container having an open interior for storing fuel communicating with said tube passage;

a collar including a cap for closing the upper end of said tube and having a helical thread cooperatively engaging the thread of said tube and a collar ring disposed adjacent the upper end of said tube and extending radially outward therefrom, said collar being diametrically larger than the base opening;

said cap defining an opening adapted to receive the wick, the wick extending from within the interior of said fuel container, through said tube passage and through said cap opening; and, said tube being so sized relative to the opening in the base structure to be inserted into the opening so that said burner is suspended therewithin by action of the collar resting on the base structure surrounding the opening.

2. The burner of claim 1 wherein said fuel container is a flexible bladder positioned circumferentially around the lower end of said tube with said tube passage communicating with the interior of said bladder, said tube adjacent its lower end and underlying said bladder including an external circumferential surface of a diameter differing from the tube diameter thereabove, and a band disposed circumferentially about said bladder radially outward of said external surface to hold said bladder on the lower end of said tube.

3. The burner of claim 2 wherein said external surface is comprised of a flange ring extending radially outward from said tube adjacent its lower end, said flexible bladder overlying said flange ring.

4. The burner of claim 3 wherein said tube has an external helical thread adjacent its lower end and said flange ring is non-integral with said tube and defines an opening with an internal helical thread adapted to cooperate with said tube lower external thread, whereby said flange ring may be screwed onto said tube to secure it thereto.

5. The burner of claim 3 wherein said flange ring is non-integral with said tube and defines an internal opening that is diametrically sized relative to the exterior of said tube such that said flange ring can be press fit and held by friction onto said tube adjacent its lower end.

6. The burner of claim 3 wherein said band includes insulation circumferentially overlying said flexible bladder, heat shrink tubing circumferentially overlying said insulation, and an annular clamp circumferentially overlying said heat shrink tubing.

7. The burner of claim 2 wherein a second flexible bladder is positioned about the first flexible bladder and circumferentially around said external surface, said band being disposed over said second bladder, said bladder being wrapped by said band to hold both said first and second bladders on the lower end of said tube.

8. The burner of claim 2 wherein said band includes insulation circumferentially overlying said flexible bladder.

9. The burner of claim 8 wherein said insulation is fiberglass tape.

10. The burner of claim 8 wherein said band includes heat shrink tubing circumferentially overlying said flexible bladder and said insulation.

11. The burner of claim 2 wherein said circumferential band includes heat shrink tubing circumferentially overlying said flexible bladder.

12. The burner of claim 11 wherein said band further includes an annular clamp circumferentially overlying said heat shrink tubing.

13. The burner of claim 2 wherein insulation is circumferentially positioned around said tube and underlies said flexible bladder.

14. The burner of claim 2 wherein said band is an annular clamp circumferentially disposed around said bladder that may be tightened to hold said bladder on said tube.

15. The burner of claim 2 wherein said bladder has multiple necks, each neck being attached to a separate tube, each of which is suspended from the base, whereby the burner provides multiple flames supplied by a common fuel source.

16. The burner of claim 2 wherein the combustion fuel is lamp oil and said flexible bladder is made of material that is impermeable to lamp oil and chemically unreactive with lamp oil.

17. The burner of claim 2 wherein said bladder is made of a material selected from the group consisting of mylar, polyethylene, vinyl, polyester and polyvinyl chloride.

18. The burner of claim 1 wherein said tube is comprised of an outer tube having an internal passage extending axially between upper and lower ends and an inner tube disposed coaxially within said outer tube and having an internal passage extending axially between upper and lower ends, said wick being disposed within said tube passages, said inner tube extending upwardly from said outer tube and having a helical thread adjacent its upper end adapted to cooperate with said cap thread, whereby said cap may be screwed onto said inner tube to secure it thereto.

19. The burner of claim 18 wherein said inner tube has an external helical thread adjacent its lower end, and said outer tube passage and said inner tube lower end are so sized such that when said lower end of said inner tube is positioned within said outer tube said inner tube external thread engages the outer tube to secure said inner tube within said outer tube.

20. The burner of claim 18 wherein said fuel container is a flexible bladder positioned circumferentially around the lower end of said outer tube with said tube passages communicating with the interior of said bladder, said inner tube extending downwardly from said outer tube and having a helical thread adjacent its lower end, and further including a flange ring extending radially outward from said outer tube adjacent its lower end, said flange ring being non-integral with said tubes and having an opening with an internal helical thread adapted to cooperate with said inner tube lower external thread, whereby said flange ring maybe screwed onto said inner tube to secure it thereto, said flexible bladder being positioned over said flange ring.

21. The burner of claim 18 wherein said outer tube is made of plastic.

22. The burner of claim 18 wherein said inner tube is made of metal.

23. The burner of claim 1 wherein said wick is made of a material selected from the group consisting of cotton, fiberglass and a combination of cotton and fiberglass.

24. The burner of claim 1 wherein said wick has a lower end extending into the interior of the fuel container and further including a weight attached adjacent the lower end of said wick to hold the lower end of said wick at the bottom of the fuel container.

25. The burner of claim 1 wherein said cap and collar ring of said collar are non-integral.

26. The burner of claim 25 wherein said tube thread is an external thread, said collar ring defining an opening with an internal helical thread adapted to cooperate with said tube thread, whereby said collar ring may be screwed onto said tube to secure it thereto.

27. The burner of claim 26 wherein said cap is positioned at the upper end of said tube and said collar ring is positioned inboard on said tube below said cap.

28. The burner of claim 27 wherein said collar ring is fixedly secured to the supporting base.

29. The burner of claim 1 wherein said cap defines more than one opening adapted to receive a wick, and further including one wick for each opening.

30. The burner of claim 1 wherein said fuel container is a bottle with an outward extending neck, and including an external helical thread on said bottle neck and an internal helical thread on said tube adjacent its lower end adapted to cooperatively engage said bottle thread, whereby the bottle may be screwed onto said tube to secure the bottle to the bottom of the tube.

31. The burner of claim 1 wherein said fuel container is a bottle, and including a neck on said bottle having an internal diameter so sized relative to the external diameter of the tube such that the bottle may be press fit onto the tube inserted therein and held thereon by friction.

32. The burner of claim 31 wherein said bottle is a plastic bottle, and further including a clamp band positioned circumferentially around the bottle neck that may be tightened to secure the bottle on the tube.

33. The burner of claim 1 wherein said cap includes a nut screwed onto said tube helical thread with a radially extending upper wall at least partially blocking said tube passage at the tube upper end, said upper wall defining the cap opening and a wick holder inserted into said cap opening and defining a wick opening through which said wick extends.

34. The burner of claim 33 wherein a split seal ring is placed between said cap nut and said tube upper end, said split seal ring holding said wick holder when said cap nut is screwed onto said tube, whereby the gap defined by the split in said seal ring defines a small vent hole permitting ambient air to enter said fuel container interior as fuel is drawn through said wick and burned.

35. The burner of claim 34 wherein said cap includes an upper wall extending radially outward to its periphery and an annular skirt extending downwardly from the periphery of said upper wall, the inner surface of said skirt having a helical thread, the thread of the upper end of said tube being external and adapted to cooperatively engage the helical thread of said cap thereby permitting said cap to be removably secured to said tube with its upper wall blocking the upper tube end.

36. A base for holding a plurality of burners constructed in accordance with claim 1, said base defining a plurality of openings from which said burners may be inserted and suspended.

37. A liquid fuel burner with a wick and a fuel storage container adapted to be inserted into an opening in a supporting base, the burner comprising:

a tube having upper and lower ends with an internal passage extending axially between said upper and lower ends, said tube having a helical thread adjacent its upper end;

a collar including a cap for closing the upper end of said tube and having a helical thread cooperatively engaging the thread of said tube and a collar ring disposed adjacent to the upper end of said tube and extending radially outward therefrom, said collar being diametrically larger than the base opening;

a flange ring carried by said tube and extending radially outward from said tube adjacent its lower end;

said fuel container being defined by a flexible bladder positioned circumferentially around the lower end of said tube and overlying said flange ring with said tube passage communicating with the interior of said bladder;

a band disposed circumferentially about said bladder and overlying said flange ring to hold said bladder on the lower end of said tube;

said cap defining an opening adapted to receive the wick, the wick extending from within the interior of said bladder, through said tube passage and through said cap opening; and, said tube being so sized relative to the opening in the base structure to be inserted into the opening so that said burner is suspended therewithin by action of the collar resting on the base structure surrounding the opening.

38. The burner of claim 37 further including a second flexible bladder surrounding said first bladder, said band overlying both of said bladders.

39. The burner of claim 37 wherein said tube has an external helical thread adjacent its lower end, said flange ring is non-integral with said tube and defines an opening with an internal helical thread adapted to cooperate with said tube lower external thread, whereby said flange ring may be screwed onto said tube to secure it thereto.

40. The burner of claim 37 wherein said flange ring is non-integral with said tube and defines an internal opening that is diametrically sized relative to the exterior of said tube that said flange ring can be press fit and held by friction on said tube adjacent its lower end.

41. The burner of claim 37 wherein said tube is comprised of an outer tube having an internal passage extending axially between upper and lower ends and an inner tube disposed coaxially within said outer tube and having an internal passage extending axially between upper and lower ends, said wick being disposed within said tube passages, said inner tube extending upwardly from said outer tube and having a helical thread adjacent its upper end adapted to cooperate with said cap thread, whereby said cap may be screwed onto said inner tube to secure it thereto.

42. A liquid fuel burner with a wick and a fuel storage container adapted to be inserted into an opening in a supporting base, the burner comprising:

a pair of tubes including a plastic outer tube having an internal passage extending axially between upper and lower ends and a metal inner tube disposed coaxially within said outer tube and having an internal passage extending axially between upper and lower ends, said inner tube extending upwardly from said outer tube and having a helical thread adjacent its upper end;

a collar ring mounted adjacent the upper end of said inner tube and extending radially outward therefrom, said collar being diametrically larger than the base opening;

a cap for closing the upper end of said inner tube and having a helical thread cooperatively engaging the helical thread of said inner tube to fix said cap thereto outboard of said collar ring;

a flange ring carried by one of said tubes and extending radially outward from said outer tube adjacent its lower end;

said fuel container being defined by a flexible bladder positioned circumferentially around the lower end of said outer tube with said tube passages communicating with the interior of said bladder;

a band disposed circumferentially about said bladder and overlying said flange ring to hold said bladder on the lower end of said tube;

said cap defining an opening adapted to receive the wick, the wick extending from within the interior of said bladder, through said tube passages and through said cap opening; and, said tube being so sized relative to the opening in the base structure to be inserted into the opening so that said burner is suspended therewithin by action of the collar resting on the base structure surrounding the opening.

43. The burner of claim 42 wherein said inner tube has an external thread adjacent its lower end and said inner tube extends below the lower end of said outer tube to expose said inner tube lower thread, said flange ring defining an opening with an internal helical thread adapted to cooperate with said inner tube lower thread, whereby said flange ring may be screwed onto said tube to secure it thereto.

44. A liquid fuel burner with a wick and a fuel storage container adapted to be inserted into an opening in a supporting base, the burner comprising:

a pair of tubes including a plastic outer tube having an internal passage extending axially between upper and lower ends and a metal inner tube disposed coaxially within said outer tube and having an internal passage extending axially between upper and lower ends, said inner tube extending upwardly from said outer tube and having a helical thread adjacent its upper end, said inner tube extending downwardly from said outer tube and having a helical thread adjacent its lower end;

a collar ring having an opening defining an internal helical thread adapted to cooperatively engage the upper thread of said inner tube to mount said collar ring adjacent the upper end of said inner tube, said collar extending radially outward from the inner tube and being diametrically larger than the base opening;

a cap for closing the upper end of said inner tube and having a helical thread adapted to cooperatively engage the upper thread of said inner tube to fix said cap thereto outboard of said collar ring;

a flange ring defining an opening with a helical thread adapted to cooperatively engage with said inner tube lower thread to fix said flange ring adjacent its lower end, said flange ring extending radially outward from said outer tube;

said fuel container being defined by a pair of flexible bladders, a first bladder being disposed within the interior of a second bladder, said first bladder being positioned circumferentially around the lower end of said outer tube with said tube passages communicating with the interior of said first bladder;

a first band of material circumferentially overlying said flange ring and said first and second bladders to hold both of said bladders on said tubes, said first band being made of insulating material;

a second band of material circumferentially overlying at least a portion of said first band to maintain said first band in position overlying said bladders and on said tubes;

said cap defining an opening adapted to receive the wick, the wick extending from within the interior of said bladder, through said tube passages and through said cap opening; and, said tube being so sized relative to the opening in the base structure to be inserted into the opening so that said burner is suspended therewithin by action of the collar resting on the base structure surrounding the opening.

45. A liquid fuel burner with a wick and a fuel storage container adapted to be inserted into an opening in a supporting base, the burner comprising:

a tube having upper and lower ends with an internal passage extending axially between said upper and lower ends, the fuel container being mounted to said tube adjacent the lower end thereof, the container having an open interior for storing fuel communicating with said tube passage;

a collar including a cap for closing the upper end of said tube and a collar ring disposed adjacent the upper end of said tube and extending radially outward therefrom, said collar being diametrically larger than the base opening;

cooperatively engaging retainer means on said upper end of said tube and said cap for removably securing said cap to said tube;

said cap defining an opening adapted to receive the wick, the wick extending from within the interior of said fuel container, through said tube passage and through said cap opening; and, said tube being so sized relative to the opening in the base structure to be inserted into the opening so that said burner is suspended therewithin by action of the collar resting on the base structure surrounding the opening.

46. The burner of claim 45 wherein said tube is comprised of an outer tube having an internal passage extending axially between upper and lower ends and an inner tube disposed coaxially within said outer tube and having an internal passage extending axially between upper and lower ends, said wick being disposed within said tube passages, said inner tube extending upwardly from said outer tube, cooperatively engaging retainer means on said upper end of said inner tube and on said cap for removably securing said cap to said tube, whereby said cap may be screwed onto said inner tube to secure it thereto.

* * * * *